US007112038B2

(12) United States Patent
Curtis et al.

(10) Patent No.: US 7,112,038 B2
(45) Date of Patent: Sep. 26, 2006

(54) BLOWER MUFFLER AND VIBRATION ISOLATION

(76) Inventors: David A. Curtis, 206 Highfield St., Torrington, CT (US) 06790; Robert A. Hoyt, 132 Louisiana Ave., Bristol, CT (US) 06010; Russel H. Marvin, 88 E. Hyerdale Dr., Goshen, CT (US) 06756; Bret Sleicher, 23 Burritt Pl., Naugatuck, CT (US) 06770

( * ) Notice: Subject to any disclaimer, the term of this patent is extended or adjusted under 35 U.S.C. 154(b) by 106 days.

(21) Appl. No.: 10/955,538

(22) Filed: Sep. 29, 2004

(65) Prior Publication Data

US 2005/0106039 A1 May 19, 2005

Related U.S. Application Data

(60) Provisional application No. 60/508,324, filed on Oct. 2, 2003.

(51) Int. Cl.
*F04D 29/66* (2006.01)

(52) U.S. Cl. ..... 415/119; 417/312; 181/225

(58) Field of Classification Search ..... 415/119
See application file for complete search history.

(56) References Cited

U.S. PATENT DOCUMENTS 2,576,860 A * 11/1951 Shapiro ..... 285/231
2,749,998 A * 6/1956 Brown et al. ..... 181/229

* cited by examiner

*Primary Examiner*—Edward K. Look
*Assistant Examiner*—Richard A. Edgar

(57) ABSTRACT

An air impeller with both sound attenuation and vibration isolation means in a compact assembly. Three muffler chambers are provided preceding the inlet to the impeller each with sound absorbing foam material and vibration isolators are provided at both inlet and discharge sides of the impeller.

7 Claims, 2 Drawing Sheets

BLOWER MUFFLER AND VIBRATION ISOLATION

RELATED APPLICATIONS

Provisional application No. 60/508,324, titled "Blower muffler and vibration isolation" filed Oct. 2, 2003, inventors David A. Curtis, Robert A. Hoyt, Russel H. Marvin, and Bret Sleicher, incorporated herein by reference.

BACKGROUND OF THE INVENTION

This invention related to sound attenuation and vibration isolation in high speed fluid moving devices such as air impellers and the like It is the general object of the invention to provide a compact assembly of relatively simple design which is highly effective in both sound reduction and vibration isolation and which can yet be manufactured at low cost.

SUMMARY OF INVENTION

In fulfillment of the foregoing object and in accordance with the present invention, a housing is provided and defines a chamber for receiving an air impeller and an associated electric drive motor. The impeller may be of the centrifugal, axial flow or other type and the motor may of course also vary substantially in construction and operation. The impeller has an inlet opening and a discharge opening and the housing has an inlet opening remote from the impeller inlet opening and a discharge opening in communication with the impeller discharge opening. At least two and preferably three sound attenuation chambers are also defined by the housing and are arranged to receive air seriatim from the housing inlet opening and discharge the same to the impeller inlet opening. Openings are provided between chambers with the areas of the openings and the lengths of the chambers selected for optimum sound attenuation, preferably in the frequency range approximately 60 to approximately 2000 hz. Finally, flexible elastomeric vibration isolators are provided at both housing inlet and discharge openings.

DESCRIPTION OF THE PREFERRED EMBODIMENT

Figure 1:
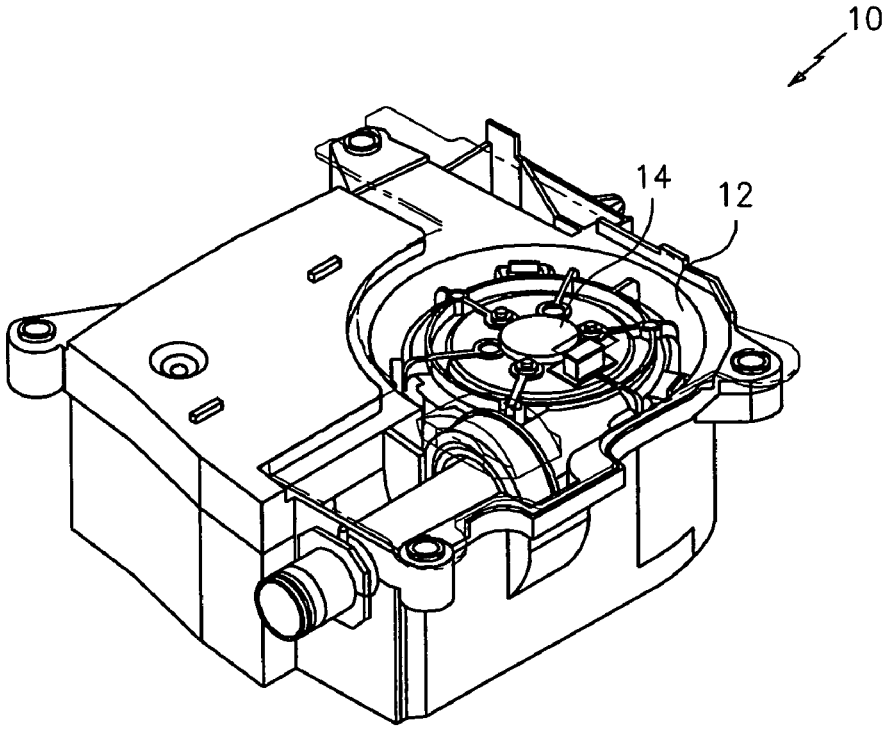
FIG. 1 is a top view of the assembly in perspective with a cover plate removed.
Figure 3:
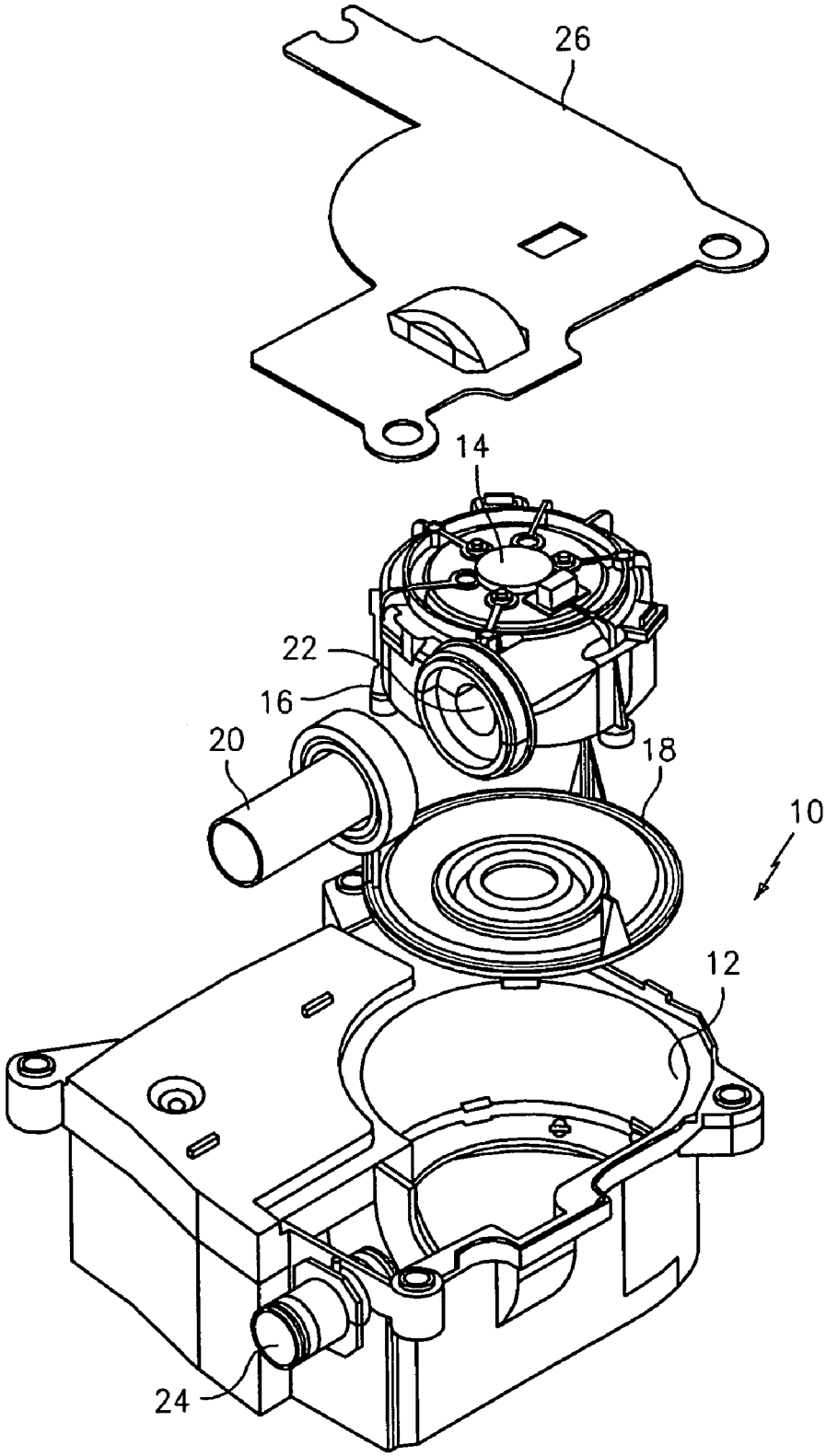
FIG. 3 is an exploded perspective view showing various parts of the assembly.

Referring particularly to FIGS. 1 and 3, a housing is indicated generally at 10 and as will be seen takes a generally square shape in plain view. The housing 10 defines a chamber 12 which receives an electric motor 14 driving an air impeller 16. An inlet vibration isolator in disc form is also included at 18 in FIG. 3 and an outlet vibration isolator 20 takes a tubular form and receives air from an impeller discharge opening 22 and discharges the air to housing discharge opening 24. Finally, a sound absorbing steel plate 26 covers the noise generating portion of the assembly comprising the motor and impeller.

Figure 2:
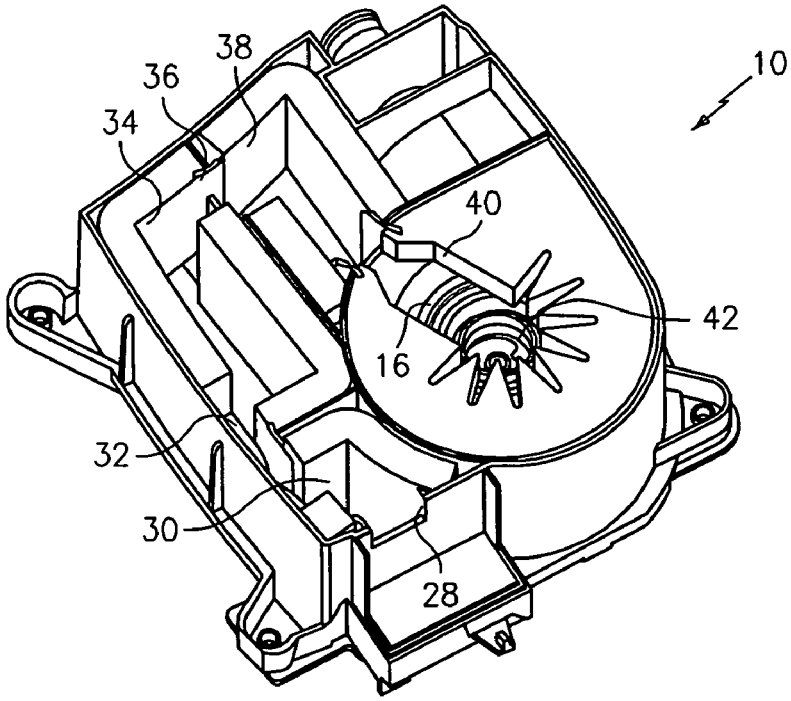
FIG. 2 is a bottom view in perspective also with a cover plate removed.

In FIG. 2 the sound absorbing construction of the interior of the housing 10 is clearly disclosed. Air inlet opening 28 introduces ambient air to a first and shortest muffler chamber 30 and passageway 32 communicates with the chamber 30 and with a second and somewhat larger, intermediate size, muffler chamber 34. From the chamber 34 the air passes through passageway 36 to the final and largest muffler chamber 38 and thence through passageway 40 to impeller inlet 42. All three chambers 30, 34 and 38 also include sound absorbing foam material which may be conventional. At this point the geometrical arrangement of the muffler chambers should be noted. The first two chamber 30,34 are aligned along one side of the housing with passageway 36 providing a "U" turn in the path of air flow to the third chamber 38.

From the foregoing it will be apparent that a desirably compact assembly has been provided which yet exhibits all the required characteristics of sound attenuation and vibration isolation.

The invention claimed is:

1. An air impeller with muffler and vibration isolation means comprising a housing defining a chamber for receiving and enclosing an air impeller and an associated electric drive motor, an impeller and electric drive motor disposed in said chamber, and impeller having an air inlet opening and a discharge opening in the housing having an air inlet opening remote from the impeller inlet opening and a discharge opening in communication with the impeller discharge opening, said housing also includes at least two sound attenuation chambers arranged to receive air seriatim from said housing inlet opening and discharge the same to said impeller inlet opening, and means defining an opening for the passage of air from one of said chambers to the other, the area of said opening and the length of each of said chambers being selected for optimum desired sound attenuation, and flexible elastomeric vibration isolators being provided at both housing inlet and discharge openings.

2. An air impeller with muffler and vibration isolation means as set forth in claim 1 wherein the housing defines three sound attenuation chambers with interconnecting air passageways, and wherein the areas of the openings and the length of the chambers are selected for optimum desired sound attenuation.

3. An air impeller with muffler and vibration isolation means as set forth in claim 1 wherein the walls of the chambers are lined with a soft open celled acoustical foam for enhanced sound attenuation.

4. An air impeller with muffler and vibration isolation means as set forth in claim 1 wherein the lengths of the chambers and the areas of the opening therebetween are selected to provide sound attenuation in the frequency range approximately 60 to approximately 2000 hz.

5. An air impeller with muffler and vibration isolation means as set forth in claim 2 wherein the housing takes a generally rectangular configuration with the impeller, drive motor and an elongated tubular air discharge element on one side and the sound attenuation chambers on the other, the latter being formed with the shortest of three chambers receiving ambient air from the housing air inlet and discharging to the longest in a linear arrangement, the third chamber being arranged parallel and adjacent to the second chamber and receiving air from the second chamber through a short U-turn passageway and discharging to the impeller inlet.

6. An air impeller with muffler and vibration isolation means as set forth in claim 5 wherein the housing comprises a molded thermoplastic member having a back wall and short interconnected side walls and a flat steel cover plate over at least a portion of its open end.

7. An air impeller with muffler and vibration isolation means as set forth in claim 5 wherein the tubular discharge member is the vibration means for the discharge opening and the vibration isolation means for the inlet opening takes the form of a disc having a central inlet opening.

* * * * *